US007693457B2

(12) United States Patent
Kuruma et al.

(10) Patent No.: US 7,693,457 B2
(45) Date of Patent: Apr. 6, 2010

(54) CHARGING MEMBER, PROCESS CARTRIDGE, AND ELECTROPHOTOGRAPHIC APPARATUS

(75) Inventors: Yoko Kuruma, Mishima (JP); Noriaki Kuroda, Suntoh-gun (JP); Hisao Kato, Ashigarakami-gun (JP); Toshinari Miura, Kawasaki (JP); Toshiro Suzuki, Odawara (JP); Takumi Furukawa, Susono (JP); Michitaka Kitahara, Numazu (JP); Jun Murata, Tokyo (JP); Yukinori Nagata, Mishima (JP); Masaki Ozawa, Mishima (JP); Kazuyuki Shishitsuka, Tsukuba (JP)

(73) Assignee: Canon Kabushiki Kaisha, Tokyo (JP)

( * ) Notice: Subject to any disclaimer, the term of this patent is extended or adjusted under 35 U.S.C. 154(b) by 448 days.

(21) Appl. No.: 11/719,106

(22) PCT Filed: Dec. 21, 2005

(86) PCT No.: PCT/JP2005/024005

§ 371 (c)(1),
(2), (4) Date: May 11, 2007

(87) PCT Pub. No.: WO2006/070847

PCT Pub. Date: Jul. 6, 2006

(65) Prior Publication Data

US 2009/0080933 A1 Mar. 26, 2009

(30) Foreign Application Priority Data

Dec. 28, 2004 (JP) ..... 2004-379828
May 23, 2005 (JP) ..... 2005-149452
Aug. 30, 2005 (JP) ..... 2005-248688

(51) Int. Cl.
*G03G 15/02* (2006.01)

(52) U.S. Cl. ..... 399/176

(58) Field of Classification Search ..... 399/176, 399/313; 430/48; 525/477
See application file for complete search history.

(56) References Cited

U.S. PATENT DOCUMENTS

| | | | | |
|---|---|---|---|---|
| 5,080,987 | A * | 1/1992 | Odell et al. | 430/48 |
| 5,458,937 | A | 10/1995 | Nakamura et al. | 428/36.91 |
| 5,725,922 | A | 3/1998 | Nakamura et al. | 428/36.9 |
| 5,995,796 | A * | 11/1999 | Schlueter et al. | 399/313 |
| 6,066,400 | A * | 5/2000 | Law et al. | 428/412 |
| 6,067,430 | A | 5/2000 | Mammino et al. | 399/174 |
| 6,100,332 | A | 8/2000 | Yoshikawa et al. | 525/101 |
| 6,141,516 | A * | 10/2000 | Law et al. | 399/176 |
| 6,201,945 | B1 * | 3/2001 | Schlueter et al. | 399/329 |
| 6,678,495 | B1 * | 1/2004 | Badesha et al. | 430/124.33 |
| 6,721,529 | B2 * | 4/2004 | Chen et al. | 399/313 |
| 2002/0039955 | A1 | 4/2002 | Takeda et al. | 492/56 |

FOREIGN PATENT DOCUMENTS

| | | |
|---|---|---|
| EP | 0 609 038 A2 | 1/1994 |
| EP | 1 178 365 A2 | 2/2001 |
| JP | 2001-173641 | 6/2001 |

* cited by examiner

*Primary Examiner*—David P Porta
*Assistant Examiner*—Kiho Kim
(74) *Attorney, Agent, or Firm*—Fitzpatrick, Cella, Harper & Scinto

(57) ABSTRACT

A charging member has a surface layer. The surface layer contains a polysiloxane having a first unit, a second unit and a third unit each of which is represented by a specific formula. The ratio of the sum of the mole numbers of the first and second units to the sum of the mole numbers of the first to third units is in a specific range.

14 Claims, 2 Drawing Sheets

CHARGING MEMBER, PROCESS CARTRIDGE, AND ELECTROPHOTOGRAPHIC APPARATUS

TECHNICAL FIELD

This invention relates to a charging member used in electrophotographic apparatus such as copying machines or laser beam printers (LBP), and a process cartridge and an electrophotographic apparatus which have the charging member.

BACKGROUND ART

At present, a contact charging method has been put into practical use as one of methods for charging the surface of an electrophotographic photosensitive member.

The contact charging method is a method in which a voltage is applied to a charging member disposed in contact with the electrophotographic photosensitive member, to cause micro-discharge at the contact part between the charging member and the electrophotographic photosensitive member and the vicinity thereof to charge the surface of the electrophotographic photosensitive member.

In the contact charging method, a method having come into wide use is one in which a voltage created by superimposing an alternating-current voltage on a direct-current voltage is applied to the charging member (hereinafter referred also to as "AC+DC contact charging method"). In the case of the AC+DC contact charging method, a voltage having a peak-to-peak voltage that is twice or more the voltage at which the charging is started is used as the alternating-current voltage.

The AC+DC contact charging method is a method in which stable charging high in charging uniformity can be effected because of the use of the alternating-current voltage. However, insofar as an alternating-current voltage source is used, this method results in a charging assembly and an electrophotographic apparatus which are large in size and an increase in cost, as compared with a method in which only a direct-current voltage is applied to the charging member (hereinafter referred also to as "DC contact charging method").

That is, the DC contact charging method is superior to the AC+DC contact charging method in respect of minituarizing the charging assembly and electrophotographic apparatus and achieving cost reduction.

The shape of the charging member is commonly roller-shaped (hereinafter the roller-shaped charging member is referred also to as "charging roller").

In the case of the contact charging method, it is also necessary to sufficiently and uniformly secure a contact nip between the electrophotographic photosensitive member and the charging member, and hence the charging member used in the contact charging method is required to have a low hardness to a certain extent.

For such a requirement, a charging member has been proposed which has a support and an elastic layer (conductive elastic layer) provided on the support.

The elastic layer (conductive elastic layer), however, often contains low-molecular weight components in a relatively large quantity, and hence such low-molecular weight components may bleed out to contaminate the surface of the electrophotographic photosensitive member. The low-molecular weight components may include reaction initiator residues, reaction by-products, raw-material unreacted matter, vulcanizing agents, softening agents, plasticizers and conducting agents.

Accordingly, at present, in order to keep the low-molecular weight components from bleeding out, it is also prevalent that a surface layer is provided on the conductive elastic layer.

For example, Japanese Patent Application Laid-open No. 2001-173641 discloses a technique in which an inorganic-oxide film formed by a sol-gel process is used as the surface layer.

DISCLOSURE OF THE INVENTION

The technique disclosed in Japanese Patent Application Laid-open No. 2001-173641 is specifically a technique in which the surface of a roller-shaped substrate is coated with sol composed of a reaction product of a metal alkoxide with an organosilicon compound or fluorine-substituted organosilicon compound, and the applied sol is gelled to form the surface layer.

However, as a result of extensive researches on this technique conducted by the present inventors, it has been revealed that, in the film formed by a sol-gel process, containing such a siloxane compound, unreacted silanol groups or alkoxyl groups often remain in the film, and such residual silanol groups or residual alkoxyl groups may affect electrical properties of the film and furthermore charging performance of the charging member.

An object of the present invention is to provide a charging member which exhibits good charging performance even though it is a charging member having the surface layer containing a polysiloxane, specifically, a charging member which can maintain superior performance even in its repeated use in a high-humidity environment, and further to provide a process cartridge and an electrophotographic apparatus which have such a charging member.

The present invention is a charging member which comprises a surface layer containing a polysiloxane having a first unit represented by $SiO_{0.5}R^1(OR^2)(OR^3)$, a second unit represented by $SiO_{1.0}R^4(OR^5)$ and a third unit represented by $SiO_{1.5}R^6$, where $R^1$, $R^4$ and $R^6$ each independently represent a substituted or unsubstituted alkyl group or a substituted or unsubstituted aryl group, and $R^2$, $R^3$ and $R^5$ each independently represent a hydrogen atom or a substituted or unsubstituted alkyl group;

the surface layer satisfying:

$$0.60 \leqq \{(x+y)/(x+y+z)\} \leqq 0.80$$

where the number of moles of the first unit, the number of moles of the second unit and the number of moles of the third unit in the polysiloxane are represented by x (mol), y (mol) and z (mol), respectively.

The present invention is also a process cartridge and an electrophotographic apparatus which have the above charging member.

In addition, the above first unit represented by $SiO_{0.5}R^1(OR^2)(OR^3)$ is indicated by a region A1 enclosed by a square, of a polysiloxane represented by the following formula (i). In the region A1, the oxygen atom (O of Si—O—Si) which is not the oxygen atom of the alkoxyl group is bonded to two silicon atoms, and hence the number of the oxygen atom (O of Si—O—Si) bonded per each silicon atom is regarded as 0.5.

(i)

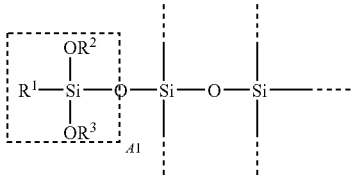

The above second unit represented by $SiO_{1.0}R^4(OR^5)$ is also similar to the first unit represented by $SiO_{0.5}R^1(OR^2)(OR^3)$, and specifically indicated by a region A2 enclosed by a square, of a polysiloxane represented by the following formula (ii).

(ii)

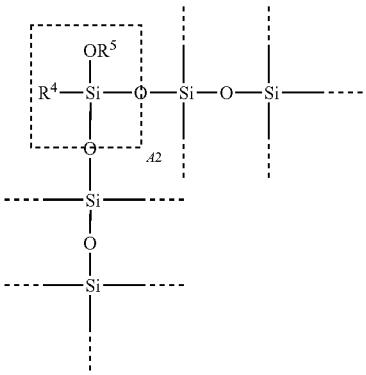

The above third unit represented by $SiO_{1.5}R^6$ is also similar to the first unit represented by $SiO_{0.5}R^1(OR^2)(OR^3)$, and specifically indicated by a region A3 enclosed by a square, of a polysiloxane represented by the following formula (iii).

(iii)

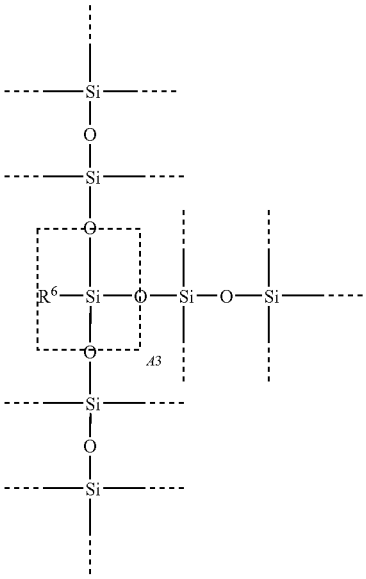

According to the present invention, it can provide a charging member which can maintain superior performance even in its repeated use in a high-humidity environment, and a process cartridge and an electrophotographic apparatus which have such a charging member.

BEST MODES FOR PRACTICING THE INVENTION

The charging member of the present invention has, as summarized above, a surface layer containing a polysiloxane having a first unit represented by $SiO_{0.5}R^1(OR^2)(OR^3)$ a second unit represented by $SiO_{1.0}R^4(OR^5)$ and a third unit represented by $SiO_{1.5}R^6$.

Then, the charging member of the present invention is for one thing characterized in that the surface layer satisfies:

$$0.60 \leqq \{(x+y)/(x+y+z)\} \leqq 0.80$$

where the number of moles of the first unit, the number of moles of the second unit and the number of moles of the third unit in the polysiloxane are represented by x (mol), y (mol) and z (mol), respectively.

Here, if the value of $\{(x+y)/(x+y+z)\}$ is too small, the electrical properties of the surface layer which are necessary for forming good images may become insufficient when used repeatedly. On the other hand, if the value of $\{(x+y)/(x+y+z)\}$ is too large, silanol groups or alkoxyl groups may be so large in content as to cause a lowering of mechanical properties of the surface layer because of moisture absorption in a high-humidity environment. More preferably, the surface layer may satisfy:

$$0.65 \leqq \{(x+y)/(x+y+z)\} \leqq 0.75.$$

In the present invention, the surface layer of the charging member may also preferably have a time constant $\tau$ (s) of $1\times10^2 \leqq \tau \leqq 1\times10^4$. If it has a too small $\tau$, the electrical properties of the surface layer which are necessary for forming good images may become insufficient when used repeatedly. On the other hand, if it has a too large $\tau$, the discharge (micro-discharge at the contact part between the charging member and the electrophotographic photosensitive member and the vicinity thereof) may take so long a time that the electrophotographic photosensitive member may come unable to be sufficiently charged when images are reproduced at a high speed.

In the present invention, the time constant $\tau$ of the charging member refers to the value found by the following measurement.

That is, an aluminum sheet (thickness: 100 μm) is coated with a surface layer coating solution used when the surface layer of the measuring object charging member is formed, and the wet coating formed is cured and dried under the same conditions as those set when the surface layer of the measuring object charging member is formed to form a layer on the aluminum sheet. In addition, the coating weight in coating the aluminum sheet with the surface layer coating solution is so controlled that the layer formed on the aluminum sheet (i.e., the layer having been cured and dried) is in a layer thickness of 10 nm.

The aluminum sheet on which the layer has been formed is cut in a square form of 4 cm×4 cm and used as a sample piece.

Gold is vacuum-deposited on the surface of this sample piece on its layer side.

Figure 2:
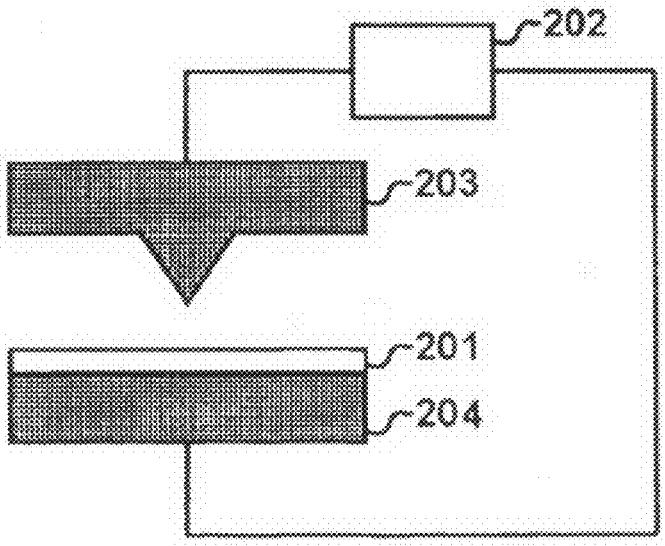
FIG. 2 illustrates the construction of a dielectric constant measuring system.

This sample piece on which gold has been vacuum-deposited is set in a dielectric constant measuring system set up as shown in FIG. 2, and the time constant of the sample piece is measured under conditions of an applied voltage of 3 V and a measurement frequency of 10 Hz. The time constant of the sample piece obtained by measurement is regarded as the time constant $\tau$ of the surface layer of the charging member which is an object to be measured (measuring object). In addition, in FIG. 2, reference numeral 201 denotes the sample piece; 202, a dielectric constant measuring instrument (a 1296 type dielectric constant measuring interface and a 1260 type impedance analyzer are used in combination; manufactured by Solartron Co., U.K.); 203, a contact electrode terminal; and 204, a flat-plate electrode.

The aryl groups (aryl groups of the above $R^1$, $R^4$ and $R^6$) in the polysiloxane may preferably be in a content of from 5 to 30% by mass based on the total mass of the polysiloxane. The oxyalkylene groups (oxyalkylene groups in the above $OR^2$, $OR^3$ and $OR^5$) in the polysiloxane may preferably be in a content of from 5 to 70% by mass based on the total mass of the polysiloxane. The siloxane moieties in the polysiloxane may preferably be in a content of from 20 to 90% by mass based on the total mass of the polysiloxane.

The polysiloxane may also preferably be one having an alkyl fluoride group. In such a case, the aryl groups in the polysiloxane may preferably be in a content of from 5 to 30% by mass based on the total mass of the polysiloxane, the oxyalkylene groups in the polysiloxane may preferably be in a content of from 5 to 70% by mass based on the total mass of the polysiloxane, the alkyl fluoride groups in the polysiloxane may preferably be in a content of from 5 to 50% by mass based on the total mass of the polysiloxane, and the siloxane moieties in the polysiloxane may preferably be in a content of from 20 to 85% by mass based on the total mass of the polysiloxane.

The alkyl fluoride group may include, e.g., straight-chain or branched alkyl groups the hydrogen atoms of which are replaced partly or totally with a fluorine atom(s). In particular, straight-chain perfluoroalkyl groups having 6 to 31 carbon atoms are preferable.

The oxyalkylene group is a divalent group having a structure represented by —O—R— (R: an alkylene group) (also called "alkylene ether group"). This R (alkylene group) may preferably be an alkylene group having 1 to 6 carbon atoms.

The polysiloxane incorporated in the surface layer of the charging member of the present invention may be obtained through, e.g., the following steps (I) and (II).

(I) A condensation step in which a hydrolyzable silane compound having an aryl group and a hydrolyzable silane compound having a cationic-polymerizable group are condensed by hydrolysis.

(II) A cross-linkage step in which the cationic-polymerizable group is cleaved to cross-link the hydrolyzable condensation product obtained through the step (I).

The water used in the hydrolysis in the step (I) may preferably be in an amount ranging from 30 to 50% by mass based on the total mass of the hydrolyzable silane compounds used in the step (I).

As the hydrolyzable silane compound having an aryl group, a hydrolyzable silane compound having a structure represented by the following formula (1) is preferable.

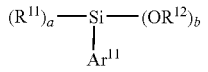

(1)

In the formula (1), $R^{11}$ and $R^{12}$ each independently represent a substituted or unsubstituted alkyl group, and $Ar^{11}$ represents an aryl group. Letter symbol a is an integer of 0 to 2, b is an integer of 1 to 3, and a+b is 3.

As the alkyl group represented by $R^{11}$ and $R^{12}$ in the formula (1), it may preferably be a methyl group, an ethyl group or a propyl group.

As the aryl group represented by $Ar^{11}$, a phenyl group is preferable.

Specific examples of the hydrolyzable silane compound having an aryl group are shown below.

(1-1): Phenyltrimethoxysilane (1-2): Phenyltriethoxysilane (1-3): Phenyltripropoxysilane (1-4): Diphenyldimethoxysilane (1-5): Diphenyldiethoxysilane As the hydrolyzable silane compound having a cationic-polymerizable group, it may preferably be a hydrolyzable silane compound having a structure represented by the following formula (2).

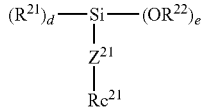

(2)

In the formula (2), $R^{21}$ and $R^{22}$ each independently represent a substituted or unsubstituted alkyl group, $Z^{21}$ represents a divalent organic group, and $Rc^{21}$ represents a cationic-polymerizable group. Letter symbol d is an integer of 0 to 2, e is an integer of 1 to 3, and d+e is 3.

The cationic-polymerizable group represented by $Rc^{21}$ is meant to be a cationic-polymerizable organic group capable of forming an oxyalkylene group by cleavage, and may include, e.g., cyclic ether groups such as an epoxy group and an oxetane group, and vinyl ether groups. Of these, an epoxy group is preferred from the viewpoint of ready availability and ready reaction controllability.

As the alkyl group represented by $R^{21}$ and $R^{22}$ in the formula (2), a straight-chain or branched alkyl group having 1 to 3 carbon atoms is preferable, and a methyl group or an ethyl group is more preferable.

The divalent organic group represented by $Z^{21}$ in the formula (2) may include, e.g., alkylene groups and arylene groups. Of these, alkylene groups having 1 to 6 carbon atoms are preferred, and an ethylene group is more preferred.

The e in the formula (2) may preferably be 3.

Where the d in the formula (2) is 2, the two $R^{21}$'s may be the same or different.

Where the e in the formula (2) is 2 or 3, the two or three $R^{22}$'s may be the same or different.

Specific examples of the hydrolyzable silane compound having the structure represented by the formula (2) are shown below.

(2-1): Glycidoxypropyltrimethoxysilane (2-2): Glycidoxypropyltriethoxysilane (2-3): Epoxycyclohexylethyltrimethoxysilane (2-4): Epoxycyclohexylethyltriethoxysilane From the viewpoint of improvement in surface releasability of the charging member to be produced, not only the hydrolyzable silane compound having an aryl group and the hydrolyzable silane compound having a cationic-polymerizable group but also a hydrolyzable silane compound having a structure represented by the following formula (3) may be used as a third raw-material in combination in the step (I). When using the hydrolyzable silane compound having a structure represented by the following formula (3), the resultant polysiloxane comes to be the polysiloxane having an alkyl fluoride group (perfluoroalkyl group).

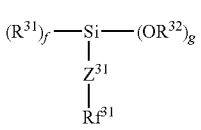

(3)

In the formula (3), $R^{31}$ and $R^{32}$ each independently represent a substituted or unsubstituted alkyl group, $Z^{31}$ represents a divalent organic group, and $Rf^{31}$ represents a perfluoroalkyl group having 1 to 31 carbon atoms. Letter symbol f is an integer of 0 to 2, g is an integer of 1 to 3, and f+g is 3.

The alkyl group represented by $R^{31}$ and $R^{32}$ in the formula (3) is preferably a straight-chain or branched alkyl group having 1 to 3 carbon atoms, and further preferably a methyl group or an ethyl group.

The divalent organic group represented by $Z^{31}$ in the formula (3) may include, e.g., alkylene groups and arylene groups. Of these, alkylene groups having 1 to 6 carbon atoms are preferred, and further an ethylene group is more preferred.

As the straight-chain perfluoroalkyl group having 1 to 31 carbon atoms, represented by $Rf^{31}$ in the formula (3), it may preferably be a straight-chain perfluoroalkyl group having 6 to 31 carbon atoms.

The g in the formula (3) may preferably be 3.

Where the f in the formula (3) is 2, the two $R^{31}$'s may be the same or different.

Where the g in the formula (3) is 2 or 3, the two or three $R^{32}$'s may be the same or different.

Specific examples of the hydrolyzable silane compound having the structure represented by the formula (3) are shown below.

$$CF_3—(CH_2)_2—Si—(OR)_3 \quad (3\text{-}1)$$

$$F(CF_2)_2—(CH_2)_2—Si—(OR)_3 \quad (3\text{-}2)$$

$$F(CF_2)_4—(CH_2)_2—Si—(OR)_3 \quad (3\text{-}3)$$

$$F(CF_2)_6—(CH_2)_2—Si—(OR)_3 \quad (3\text{-}4)$$

$$F(CF_2)_8—(CH_2)_2—Si—(OR)_3 \quad (3\text{-}5)$$

$$F(CF_2)_{10}—(CH_2)_2—Si—(OR)_3 \quad (3\text{-}6)$$

R in the formulas (3-1) to (3-6) represents a methyl group or an ethyl group.

Of the above (3-1) to (3-6), (3-4) to (3-6) are preferred.

The hydrolyzable silane compound having an aryl group, the hydrolyzable silane compound having a cationic-polymerizable group and the hydrolyzable silane compound having an alkyl fluoride group may each be used alone, or may be used in combination with two or more types.

In the present invention, in the step (I), hydrolyzable silane compounds other than the hydrolyzable silane compounds described above may further be used in combination.

The hydrolyzable silane compounds other than the hydrolyzable silane compounds described above may include, e.g., a hydrolyzable silane compound having a structure represented by the following formula (4).

$$(R^{41})_h—Si—(OR^{42})_k \quad (4)$$

In the formula (4), $R^{41}$ represents a phenyl group substituted alkyl group or an unsubstituted alkyl group or an alkyl group substituted aryl group or an unsubstituted aryl group. $R^{42}$ represents a saturated or unsaturated monovalent hydrocarbon group. Letter symbol h is an integer of 0 to 3, k is an integer of 1 to 4, and h+k is 4.

As the alkyl group of the phenyl group substituted alkyl group or unsubstituted alkyl group represented by $R^{41}$ in the formula (4), a straight-chain alkyl group having 1 to 21 carbon atoms is preferable.

As the aryl group of the alkyl group substituted aryl group or unsubstituted aryl group represented by $R^{41}$ in the formula (4), a phenyl group is preferable.

The h in the formula (4) may preferably be an integer of 1 to 3, and more preferably be 3.

The k in the formula (4) may preferably be an integer of 1 to 3, and more preferably be 3.

The saturated or unsaturated monovalent hydrocarbon group represented by $R^{42}$ in the formula (4) may include, e.g., alkyl groups, alkenyl groups and aryl groups. Of these, straight-chain or branched alkyl groups having 1 to 3 carbon atoms are preferred, and may further preferably be a methyl group, an ethyl group or a n-propyl group.

Where the h in the formula (4) is 2 or 3, the two or three $R^{41}$'s may be the same or different.

Where the k in the formula (4) is 2, 3 or 4, the two, three or four $R^{42}$'s may be the same or different.

Specific examples of the hydrolyzable silane compound having the structure represented by the formula (4) are shown below.

(4-1): Tetramethoxysilane (4-2): Tetraethoxysilane (4-3): Tetrapropoxysilane (4-4): Methyltrimethoxysilane (4-5): Methyltriethoxysilane (4-6): Methyltripropoxysilane (4-7): Ethyltrimethoxysilane (4-8): Ethyltriethoxysilane (4-9): Ethyltripropoxysilane (4-10): Propyltrimethoxysilane (4-11): Propyltriethoxysilane (4-12): Propyltripropoxysilane (4-13): Hexyltrimethoxysilane (4-14): Hexyltriethoxysilane (4-15): Phenyltripropoxysilane (4-16): Decyltrimethoxysilane (4-17): Decyltriethoxysilane (4-18): Decyltripropoxysilane The construction of the charging member of the present invention is described next, inclusive of a specific method of forming the surface layer containing the polysiloxane.

Figure 1:
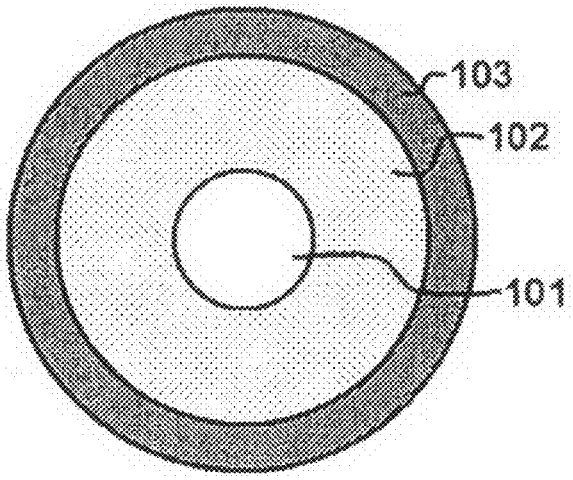
FIG. 1 illustrates an example of the construction of the charging member of the present invention.

An example of the construction of the charging member of the present invention is shown in FIG. 1. In FIG. 1, reference numeral 101 denotes a support; 102, the conductive elastic layer; and 103, the surface layer.

From the viewpoint of sufficiently securing a contact nip between the electrophotographic photosensitive member and the charging member, the charging member may preferably be so constructed that, as shown, e.g., in FIG. 1, the conductive elastic layer is provided between the support and the surface layer. In other words, the charging member may preferably be one having a support, a conductive elastic layer formed on the support, and a surface layer formed on the conductive elastic layer. Also, one or two or more other layer(s) may be provided between the support and the conductive elastic layer or between the conductive elastic layer and the surface layer.

The charging member is described below taking as an example the case of the charging member having a support, a conductive elastic layer formed on the support, and a surface layer formed on the conductive elastic layer.

Only the requirement for the support of the charging member is to have conductivity (conductive support). For example, a support made of a metal (or made of an alloy) such as iron, copper, stainless steel, aluminum or nickel may be used. Also, for the purpose of providing scratch resistance, surface treatment such as plating may be applied to the surface of any of these supports as long as its conductivity is not impaired.

In the conductive elastic layer, one or two or more of elastic materials such as rubbers or thermoplastic elastomers may be used which are used in elastic layers (conductive elastic layers) of conventional charging members.

The rubbers may include, e.g., urethane rubbers, silicone rubbers, butadiene rubbers, isoprene rubbers, chloroprene rubbers, styrene-butadiene rubbers, ethylene-propylene rubbers, polynorbornene rubbers, styrene-butadiene-styrene rubbers, acrylonitrile rubbers, epichlorohydrin rubbers and alkyl ether rubbers.

The thermoplastic elastomers may include, e.g., styrene type elastomers and olefin type elastomers. Commercially available products of the styrene type elastomers may include, e.g., RABARON, manufactured by Mitsubishi Chemical Corporation, and SEPTON COMPOUND, manufactured by Kuraray Co., Ltd. Commercially available products of the olefin type elastomers may include, e.g., THERMOLAN, manufactured by Mitsubishi Chemical Corporation, MILASTOMER, manufactured by Mitsui Petrochemical Industries, Ltd., SUMITOMO TPE, manufactured by Sumitomo Chemical Co., Ltd., and SANTOPRENE, manufactured by Advanced Elastomer Systems, L.P.

A conducting agent may also appropriately be used in the conductive elastic layer to control its conductivity at a stated value. The electrical resistance of the conductive elastic layer may be controlled by appropriately selecting the type and amount of the conducting agent to be used. The conductive elastic layer may have an electrical resistance of from $10^2$ to $10^8\Omega$ as a preferable range, and from $10^3$ to $10^6\Omega$ as a more preferable range.

The conducting agent used in the conductive elastic layer may include, e.g., cationic surface-active agents, anionic surface-active agents, amphoteric surface-active agents, antistatic agents and electrolytes.

The cationic surface-active agents may include, e.g., salts of quaternary ammoniums such as lauryl trimethylammonium, stearyl trimethylammonium, octadecyl trimethylammonium, dodecyl trimethylammonium, hexadecyl trimethylammonium, and modified fatty acid dimethyl ethylammonium. The salts of the quaternary ammoniums may specifically include perchlorate, chlorate, tetrafluoroborate, ethosulfate and benzyl halides (such as benzyl bromide and benzyl chloride).

The anionic surface-active agents may include, e.g., aliphatic sulfonates, higher alcohol sulfates, higher alcohol ethylene oxide addition sulfates, higher alcohol phosphates, and higher alcohol ethylene oxide addition phosphates.

The antistatic agents may include, e.g., nonionic antistatic agents such as higher alcohol ethylene oxides, polyethylene glycol fatty esters, and polyhydric alcohol fatty esters.

The electrolytes may include, e.g., salts (such as quaternary ammonium salts) of metals belonging to Group 1 of the periodic table (such as Li, Na and K). The salts of metals belonging to Group 1 of the periodic table may specifically include, e.g., $LiCF_3SO_3$, $NaClO_4$, $LiAsF_6$, $LiBF_4$, NaSCN, KSCN and NaCl.

As the conducting agent for the conductive elastic layer, it is possible to use salts (such as $Ca(ClO_4)_2$) of metals belonging to Group 2 of the periodic table (such as Ca and Ba), and antistatic agents derived therefrom and having at least one group (such as a hydroxyl group or a carboxyl group) having active hydrogen capable of reacting with isocyanates (such as a primary amino group or a secondary amino group). The following may also be used: ion-conductive conducting agents such as complexes of the above with polyhydric alcohols (such as 1,4-butanediol, ethylene glycol, polyethylene glycol, propylene glycol and polyethylene glycol) or derivatives thereof, and complexes of the above with monools (such as ethylene glycol monomethyl ether and ethylene glycol monoethyl ether).

As the conducting agent for the conductive elastic layer, the following may also be cited: conductive carbons such as KETJEN BLACK EC, acetylene black, rubber-purpose carbon, color(ink)-purpose carbon having been treated by oxidation, and thermally decomposed carbon. The rubber-purpose carbon may specifically include rubber-purpose carbons such as Super Abrasion Furnace (SAF: super-resistance to abrasion), Intermediate Super Abrasion Furnace (ISAF: intermediate super-resistance to abrasion), High Abrasion Furnace (HAF: high resistance to abrasion), Fast Extruding Furnace (FEF: good extrudability), General Purpose Furnace (GPF: general-purpose properties), Semi Reinforcing Furnace (SRF: semi-reinforcing properties), Fine Thermal (FT: fine-particle thermally decomposed), and Medium Thermal (MT: medium-particle thermally decomposed).

Graphites such as natural graphite and artificial graphite may also be used as the conducting agent for the conductive elastic layer.

Metal oxides such as tin oxide, titanium oxide and zinc oxide and metals such as nickel, copper, silver and germanium may also be used as the conducting agent for the conductive elastic layer.

Conductive polymers such as polyaniline, polypyrrole and polyacetylene may also be used as the conducting agent for the conductive elastic layer.

An inorganic or organic filler and a cross-linking agent may also be added to the conductive elastic layer. Such a filler may include, e.g., silica (white carbon), potassium carbonate, magnesium carbonate, clay, talc, zeolite, alumina, barium sulfate and aluminum sulfate. The cross-linking agent may include, e.g., sulfur, peroxides, cross-linking auxiliaries, cross-linking accelerators, cross-linking acceleration auxiliaries, and cross-linking retarders.

From the viewpoint of keeping the charging member from being deformed when the charging member and the charging object electrophotographic photosensitive member are brought into contact with each other, it is preferable that the conductive elastic layer has a hardness of 70 degrees or greater in terms of Asker-C hardness, and particularly 73 degrees or greater.

In the present invention, the Asker-C hardness is measured under the condition of a load of 1,000 g by bringing a pressure needle of an Asker-C hardness meter (manufactured by Koubunshi Keiki Co., Ltd.) into contact with the surface of the measuring object.

A specific method of forming the surface layer is described below.

First, the hydrolyzable silane compound having an aryl group and the hydrolyzable silane compound having a cationic-polymerizable group, and optionally the hydrolyzable silane compound(s) other than the above, are subjected to hydrolysis reaction in the presence of water to produce a hydrolyzable condensation product.

When carrying out the hydrolysis reaction, the temperature and pH may be controlled so as to obtain a hydrolyzable condensation product having the desired degree of condensation.

When carrying out the hydrolysis reaction, the degree of condensation may also be controlled by using a metal alkoxide as a catalyst of the hydrolysis reaction. Such a metal alkoxide may include, e.g., aluminum alkoxides, titanium alkoxides and zirconium alkoxides, as well as complexes (such as acetylacetone complexes) of these.

In obtaining the hydrolyzable condensation product, the hydrolyzable silane compound having an aryl group and the hydrolyzable silane compound having a cationic-polymerizable group may be mixed in such a proportion that, in the polysiloxane obtained, the aryl groups are in a content of from 5 to 30% by mass based on the total mass of the polysiloxane, the oxyalkylene groups are in a content of from 5 to 70% by mass based on the total mass of the polysiloxane and the siloxane moieties are in a content of from 20 to 90% by mass based on the total mass of the polysiloxane.

Specifically, the hydrolyzable silane compound having an aryl group may preferably be so mixed as to be in the range of from 10 to 50 mol % based on the weight of all the hydrolyzable silane compounds.

In the above step (I), where the hydrolyzable silane compound having the structure represented by the formula (3) is used in combination, it is also preferable that these are so mixed that, in the polysiloxane obtained, the aryl groups are in a content of from 5 to 30% by mass based on the mass weight of the polysiloxane, the oxyalkylene groups are in a content of from 5 to 70% by mass based on the total mass of the polysiloxane, the alkyl fluoride groups are in a content of from 5 to 50% by mass based on the total mass of the polysiloxane and the siloxane moieties are in a content of from 20 to 85% by mass based on the total mass of the polysiloxane.

Specifically, the hydrolyzable silane compound having a cationic-polymerizable group and the hydrolyzable silane compound having an alkyl fluoride group may more preferably be so mixed as to be in the range of from 10:1 to 1:10 in molar ratio.

Next, a surface layer coating solution is prepared containing the hydrolyzable condensation product obtained, and the surface layer coating solution prepared is coated on a layer directly beneath the surface layer (e.g., the conductive elastic layer, or the support in some cases).

When preparing the surface layer coating solution, besides the hydrolyzable condensation product, a suitable solvent may be used in order to improve coating performance. Such a suitable solvent may include, e.g., alcohols such as ethanol and 2-butanol, ethyl acetate, and methyl ethyl ketone, or a mixture of any of these. Also, coating making use of a roll coater, dip coating, ring coating or the like may be employed in applying the surface layer coating solution onto the conductive elastic member.

Next, the surface layer coating solution applied on the conductive elastic member is irradiated with active energy radiation, whereupon cationic-polymerizable groups in the hydrolyzable condensation product contained in the surface layer coating solution are cleaved, whereby the hydrolyzable condensation product can be cross-linked. The hydrolyzable condensation product becomes cured by cross-linking.

As the active energy radiation, ultraviolet radiation is preferred.

Because of the heat generated at the time of the irradiation with active energy radiation, the conductive elastic layer of the conductive elastic member expands, and thereafter contracts as a result of cooling, where if the surface layer does not fully conform to this expansion and contraction, the surface layer may come to have wrinkles or cracks. However, where the ultraviolet radiation is used in the cross-linking reaction, the hydrolyzable condensation product can be cross-linked in a short time (within 15 minutes), and besides, heat generation is reduced. Hence, the surface layer is hardly wrinkled or cracked.

Where the charging member is placed is an environment causative of abrupt changes in temperature and humidity, the surface layer may also be wrinkled or cracked if the surface layer does not fully conform to the expansion and contraction of the conductive elastic layer because of changes in temperature and humidity. However, as long as the cross-linking reaction is carried out using the ultraviolet radiation, in which heat generation is reduced, the adherence between the conductive elastic layer and the surface layer is improved to enable the surface layer to fully conform to the expansion and contraction of the conductive elastic layer. Hence, the surface layer can also be kept from being wrinkled or cracked because of changes in temperature and humidity.

In addition, as long as the cross-linking reaction is carried out using the ultraviolet radiation, the conductive elastic layer can be kept from deteriorating due to heat history, and hence the electric properties of the conductive elastic layer can also be prevented from being lowered.

In the irradiation with ultraviolet radiation, it is possible to use a high-pressure mercury lamp, a metal halide lamp, a low-pressure mercury lamp, an excimer UV lamp and the like. Of these, an ultraviolet radiation source rich in light of from 150 to 480 nm in wavelength is used.

In addition, the integral light quantity of ultraviolet radiation is defined as follows: integral light quantity ($mJ/cm^2$)= ultraviolet radiation intensity ($mW/cm^2$)×irradiation time (s).

The integral light quantity of ultraviolet radiation may be controlled by selecting irradiation time, lamp output, distance between the lamp and the irradiation object, and so forth. The integral light quantity may also be sloped within the irradiation time.

Where the low-pressure mercury lamp is used, the integral light quantity of ultraviolet radiation may be measured with an ultraviolet radiation integral light quantity meter UIT-150-A or UVD-S254, manufactured by Ushio Inc. Where the excimer UV lamp is used, the integral light quantity of ultraviolet radiation may be measured with an ultraviolet radiation integral light quantity meter UIT-150-A or VUV-S172, manufactured by Ushio Inc.

From the viewpoint of improving cross-linking efficiency, it is preferred that the cross-linking reaction is carried out in the presence of a cationic polymerization catalyst (polymerization initiator). For example, the epoxy group is highly reactive with an onium salt of a Lewis acid activated by active energy radiation. Accordingly, where the above cationic-polymerizable group is an epoxy group, an onium salt of a Lewis acid may preferably be used as the cationic polymerization catalyst.

Other cationic polymerization catalysts may include, e.g., borates, compounds having an imide structure, compounds having a triazine structure, azo compounds, and peroxides.

Of such cationic polymerization catalysts, aromatic sulfonium salts and aromatic iodonium salts are preferred from the viewpoint of sensitivity, stability and reactivity. In particular, it is preferred to use a bis(4-tert-butylphenyl) iodonium salt, a compound having a structure represented by the following formula (trade name: ADEKA OPTOMER SP150, available from Asahi Denka Kogyo K.K.):

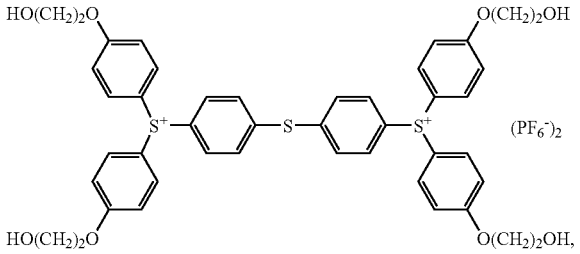

a compound having a structure represented by the following formula (trade name: IRGACURE 261, available from Ciba Specialty Chemicals Inc.):

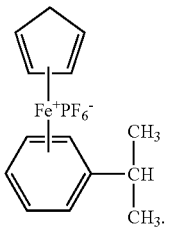

The cationic polymerization catalyst may be used in an amount of from 0.1 to 3% by mass based on the mass of the hydrolyzable condensation product.

From the viewpoint of keeping toner or external additives from adhering to the surface of the charging member, the surface of the charging member (i.e., the surface of the surface layer) may also preferably have a roughness (Rz) of 10 μm or less according to JIS 94, more preferably 7 μm or less, and still more preferably 5 μm or less.

From the viewpoint of sufficiently securing the contact nip between the electrophotographic photosensitive member and the charging member, the surface layer of the charging member may preferably have a modulus of elasticity of 5,000 MPa or less. On the other hand, in general, layers show a tendency to have smaller cross-linking density as they have a smaller modulus of elasticity, and hence the surface layer of the charging member may preferably have a modulus of elasticity of 100 MPa or more, from the viewpoint of keeping low-molecular weight components in the conductive elastic layer from bleeding out of the surface of the charging member to contaminate the surface of the electrophotographic photosensitive member where the charging member is provided with the conductive elastic layer.

In addition, since the effect of keeping the low-molecular weight components from bleeding tends to be larger as the surface layer has a larger layer thickness, the surface layer may preferably have a layer thickness of 0.1 μm or more and more preferably 0.2 μm or more where the charging member is provided with the conductive elastic layer. On the other hand, since the charging member shows a tendency to be improved in charging performance as the surface layer has a smaller layer thickness, the surface layer may preferably have a layer thickness of 1.0 μm or less, and more preferably 0.6 μm or less.

Figure 3:
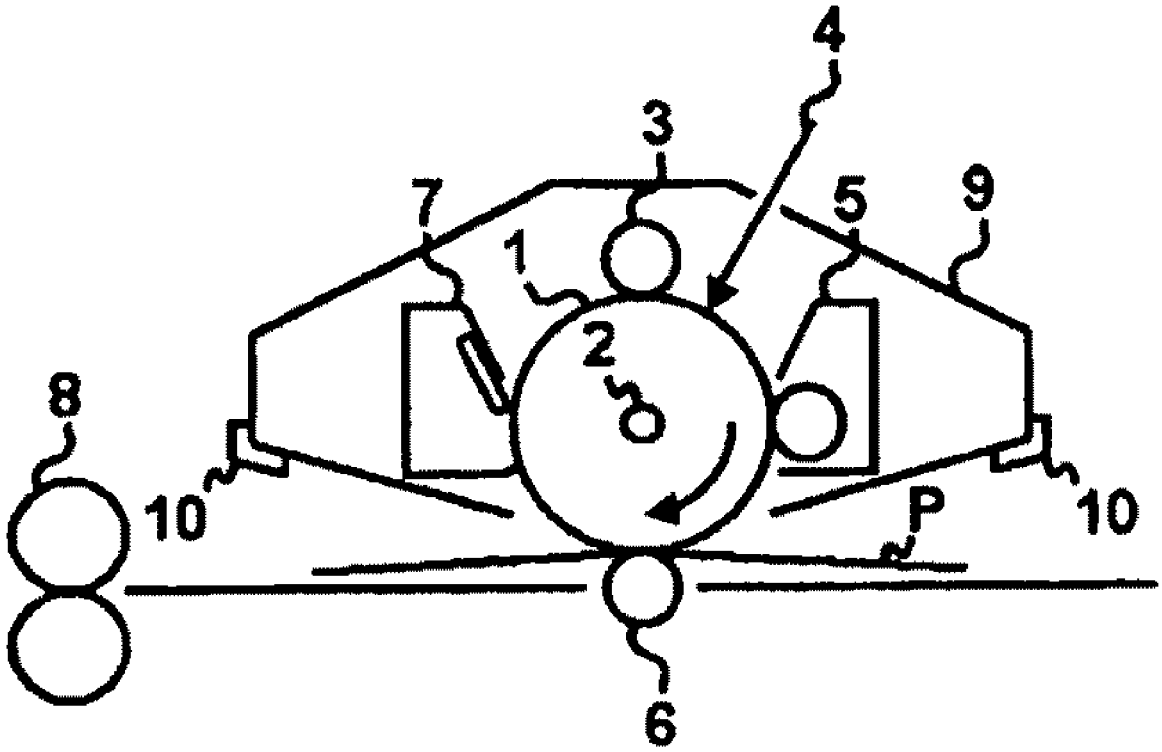
FIG. 3 schematically illustrates an example of the construction of an electrophotographic apparatus provided with a process cartridge having the charging member of the present invention.

The construction of an example of an electrophotographic apparatus provided with a process cartridge having an electrophotographic photosensitive member and the charging member of the present invention is schematically shown in FIG. 3.

In FIG. 3, reference numeral 1 denotes a cylindrical electrophotographic photosensitive member, which is rotatively driven around an axis 2 in the direction of an arrow at a stated peripheral speed. The electrophotographic photosensitive member commonly has a support and an inorganic photosensitive layer or organic photosensitive layer formed on the support. Also, the electrophotographic photosensitive member may be one having a charge injection layer as a surface layer.

The surface of the electrophotographic photosensitive member 1 which is rotatively driven is uniformly charged to a positive or negative, given potential through a charging member 3 (in FIG. 3, a roller-shaped charging member) which is the charging member of the present invention. The electrophotographic photosensitive member thus charged is then exposed to exposure light (imagewise exposure light) 4 emitted from an exposure means (not shown) for slit exposure or laser beam scanning exposure. In this way, electrostatic latent images corresponding to intended images are successively formed on the surface of the electrophotographic photosensitive member 1.

When charging the surface of the electrophotographic photosensitive member by the charging member 3, a direct-current voltage only or a voltage created by superimposing an alternating-current voltage on a direct-current voltage is applied to the charging member 3. In Examples given later, only a direct-current voltage (−1,200 V) is applied. Also, in Examples given later, dark-area potential is set at −600 V, and light-area potential at −350 V.

The electrostatic latent images thus formed on the surface of the electrophotographic photosensitive member 1 are subjected to development (reversal development or regular development) with a toner contained in a developer in a developing means 5 to come into toner images. Then the toner images thus formed and held on the surface of the electrophotographic photosensitive member 1 are successively transferred, by the aid of a transfer bias from a transfer means (such as a transfer roller) 6, to a transfer medium (such as paper) P fed from a transfer medium feed means (not shown)

to the part (contact zone) between the electrophotographic photosensitive member 1 and the transfer means 6 in the manner synchronized with the rotation of the electrophotographic photosensitive member 1.

The developing means may include, e.g., a jumping developing means, a contact developing means and a magnetic-brush developing means. The contact developing means is preferred from the viewpoint of keeping the toner from scattering. In Examples given later, the contact developing means is employed.

As for the transfer roller, it may be exemplified by one composed of a support covered with an elastic resin layer controlled to have a medium resistance.

The transfer medium P to which the toner images have been transferred is separated from the surface of the electrophotographic photosensitive member 1, is guided into a fixing means 8, where the toner images are fixed, then discharged out of the apparatus as an image-formed matter (a printing or a copy). In the case of a double-side image formation mode or a multiple image formation mode, this image-formed matter is guided into a re-circulation transport mechanism (not shown), and guided again to the transfer section.

The surface of the electrophotographic photosensitive member 1 from which the toner images have been transferred is subjected to removal of the developer (toner) remaining after the transfer, through a cleaning means (such as a cleaning blade) 7. Thus, the electrophotographic photosensitive member is cleaned on its surface, and further subjected to charge elimination by pre-exposure light (not shown) emitted from a pre-exposure means (not shown), and thereafter repeatedly used for image formation. In addition, where the charging means is a contact charging means, the pre-exposure is not necessarily required.

The charging means 3 and some of the constituents such as the above electrophotographic photosensitive member 1, developing means 5, transfer means 6 and cleaning means 7 are held together in a container to constitute a process cartridge which is detachably mountable to the main body of the electrophotographic apparatus such as a copying machine or a laser beam printer. In FIG. 3, the electrophotographic photosensitive member 1, the primary charging means 3, the developing means 5 and the cleaning means 7 are integrally supported in the cartridge to form a process cartridge 9 that is detachably mountable to the main body of the apparatus through a guide means 10 such as a rail installed in the main body of the electrophotographic apparatus.

The present invention is described below in greater detail by giving specific working examples. However, the present invention is by no means limited to these examples. In addition, in Examples, "part(s)" refers to "part(s) by mass".

Example 1

Production of Charging Roller 100 parts of epichlorohydrin rubber (trade name: EPICHLOMER CG105, available from Daiso Co., Ltd.), 2 parts of EC600JD carbon as a conducting agent (trade name: EC600JD, available from Lion Corporation), 20 parts of HS-500 carbon as a conducting agent (trade name: HS-500, available from Asahi Carbon Co., Ltd.), 5 parts of bentonite (trade name: Bengel SH manufactured by Hojun Co., Ltd.) and 5 parts of zinc oxide were kneaded for 30 minutes by means of an open roll. To the product obtained by kneading for 30 minutes, 1.0 part of di-2-benzothiazolyl disulfide as a vulcanization accelerator (trade name: NOCCELER DM-P, available from Ouchi-Shinko Chemical Industrial Co., Ltd.), 1.0 part of tetraethylthiuram disulfide as a vulcanization accelerator (trade name: NOCCELER TET-G, available from Ouchi-Shinko Chemical Industrial Co., Ltd.) and 1.2 parts of sulfur as a vulcanizing agent were added, and kneaded for further 15 minutes by means of an open roll to produce a kneaded product I.

Next, the kneaded product I was extruded by means of a rubber extruder into a cylindrical form of 9.4 mm in outer diameter and 5.4 mm in inner diameter. This was cut into a length of 250 mm, and then primarily vulcanized in a vulcanizing pan for 30 minutes using 160° C. water vapor to produce a primary-vulcanized tube I for a conductive elastic layer.

Meanwhile, a support made of steel (one having been surface-plated with nickel) in a columnar shape of 6 mm in diameter and 256 mm in length was coated with an adhesive in the areas up to 115.5 mm from both ends interposing the middle of the column surface in the axial direction (the areas of 231 mm in total in width in the axial direction, with the adhesive being a metal- and rubber-containing heat-hardening adhesive (trade name: METALOCK U-20, available from Toyokagaku Kenkyusho Co, Ltd.). The support with the adhesive applied thereon was dried at 80° C. for 30 minutes, and thereafter further dried at 120° C. for 1 hour.

This support whose columnar surface has been coated with the heat-hardening adhesive and dryed was inserted into the primary-vulcanized tube I for a conductive elastic layer, and thereafter the primary-vulcanized tube I for a conductive elastic layer was heated at 160° C. for 1 hour. Upon this heating, the primary-vulcanized tube I for a conductive elastic layer was secondarily vulcanized, and also the heat-hardening adhesive was cured. Thus, a conductive elastic roller I before surface grinding was obtained.

Next, in the conductive elastic roller I before surface grinding, the conductive elastic layer portion (rubber portion) was so cut at both ends as to have a width of 231 mm in the axial direction. Thereafter, the surface of the conductive elastic layer portion was ground with a rotary grinding wheel to produce a conductive elastic roller I (conductive elastic roller after surface grinding) which has a crown shape of 8.2 mm in diameter at end portions and 8.5 mm in diameter at the middle portion, a surface ten-point average roughness (Rz) of 5.5 μm and a run-out of 28 μm.

The ten-point average roughness (Rz) was measured according to JIS B 6101.

The run-out was measured with a high-precision laser measuring instrument LSM-430v, manufactured by Mitutoyo Corporation. For details, the outer diameter was measured with the measuring instrument, and the difference between a maximum outer diameter value and a minimum outer diameter value was regarded as outer diameter difference run-out. This measurement was made at five spots, and an average value of outer diameter difference run-out at five spots was regarded as the run-out of the measuring object.

The conductive elastic roller (conductive elastic roller after surface grinding) I thus obtained had a hardness of 78 degrees (Asker-C hardness).

Next, 37.44 g (0.156 mol, corresponding to 48.67 mol % with respect to the total weight of the hydrolyzable silane compounds) of phenyltriethoxysilane (PhTES), 21.68 g (0.078 mol) of glycidoxypropyltriethoxysilane (GPTES), 13.21 g (0.064 mol) of hexyltrimethoxysilane (HeTMS) and 11.42 g (0.022 mol) of tridecafluoro-1,1,2,2-tetrahydrooctyltriethoxysilane (FTS; the number of carbon atoms of perfluoroalkyl groups: 6) as well as 25.93 g of water and 71.91 g of ethanol were mixed. Thereafter, the resulting mixture was stirred at room temperature, and then heated and refluxed (120° C.) for 24 hours to obtain a condensation product I of hydrolyzable silane compounds. The pH in the hydrolysis reaction was 5, and the Roh was 1.5. Herein the Roh refers to the value defined as:

$$Roh=[H_2O]/[OR].$$

$[H_2O]$ stands for the number of moles of water molecules, and [OR] stands for the number of moles of all the alkoxyl groups contained in the hydrolyzable silane compounds.

This condensation product I was added to a 2-butanol/ethanol mixed solvent to prepare a condensation product-containing alcohol solution I having a solid content of 7% by mass.

Based on 100 g of this condensation product-containing alcohol solution I, 0.35 g of an aromatic sulfonium salt (trade name: ADEKA OPTOMER SP-150, available from Asahi Denka Kogyo K.K.) as a photo cationic polymerization initiator was added to the condensation product-containing alcohol solution I, and diluted with ethanol to prepare a surface layer coating solution I having a solid content of 2% by mass.

Next, the conductive elastic roller (conductive elastic roller after surface grinding) I was coated on its conductive elastic layer with the surface layer coating solution I by ring coating (ejection rate: 0.008 ml/s; speed at ring portion: 30 mm/s; total ejection rate: 0.064 ml).

Subsequently, the surface layer coating solution I applied on the conductive elastic layer by ring coating was irradiated with ultraviolet radiation of 254 nm in wavelength so as to be in an integral light quantity of 8,500 mJ/cm$^2$, and cured (curing by cross-linking reaction). The surface layer coating solution thus cured was left for a few seconds (2 or 3 seconds) to become dried to form a surface layer. A low-pressure mercury lamp manufactured by Harison Toshiba Lighting Corp. was used in the irradiation with ultraviolet radiation.

It is considered that the irradiation with ultraviolet radiation cleaved glycidoxy groups of the glycidoxypropyltrimethoxysilane to cause the cross-linking reaction of the condensation product I.

Thus, a charging roller was produced having the support, the conductive elastic layer formed on the support and the surface layer (a layer containing the polysiloxane, formed using the surface layer coating solution I) formed on the conductive elastic layer. This charging roller is designated as a charging roller I.

Measurement of Physical Properties of Charging Roller:

The surface layer of the charging roller I was 0.48 μm in layer thickness.

The charging roller I was 5.6 μm in surface roughness Rz.

The surface layer of the charging roller I was 900 MPa in modulus of elasticity. In the present invention, the modulus of elasticity was measured with a surface film physical properties tester (trade name: FISCHER SCOPE H100V; manufactured by Fischer Instruments K.K.). The value found when an indenter was pressed into the surface of the measuring object at 1 μm/7 s was regarded as the modulus of elasticity.

The time constant τ of the surface layer of the charging roller I was measured as described previously and found to be $4.44\times10^2$ s.

The composition of the surface layer of a charging roller I was analyzed in the following way.

Regarding {(x+y)/(x+y+z)}:

In the present invention, the value of {(x+y)/(x+y+z)} was measured with an $^{29}$Si solid state NMR spectrometer (trade name: CMX-300; manufactured by Chemagnetics. Inc.). A measuring sample was inserted in a probe of 7.5 mm in diameter, made from ceramics, and the value of {(x+y)/(x+y+z)} was measured by the CP/MAS method at room temperature (25° C.). The measuring sample was collected in a proper quantity from the surface layer of the charging member and pulverized, then served for use.

As a result of the measurement, the value of {(x+y)/(x+y+z)} in the surface layer of the charging roller I was found to be 0.60.

Regarding Functional Groups in Polysiloxane:

Under an optical microscope of 10 to 1,000 magnifications, about 1 mg of a sample was collected from the surface layer of a charging roller I produced in the same manner as in the above, using a three-dimensional coarse-fine adjustment micromanipulator (manufactured by K.K. Narishige) set in the optical microscope.

The sample collected was examined by the TG-MS (thermogravimetry-mass spectrometry) method (an MS device is directly connected with a TG device), and changes in concentration per mass number of the gas generated at the time of heating were followed as a function of temperature, in conjunction with changes in weight. Conditions for the measurement are shown in Table 1.

TABLE 1

| |
|---|
| Instrument: |
| TG device: TG-40 Type, manufactured by Shimadzu Corporation |
| MS device: GC/MS QP1000(1), manufactured by Shimadzu Corporation |
| Measurement conditions: |
| Start of measurement: The sample is set in the TG device, and after carrier gas is flowed for 15 minutes or more, heating is started. |
| Heating conditions: From room temperature to 1,000° C. (heating rate: 20° C./min). |
| MS sensitivity: |
| Gain 3.5 |
| Range of mass number: |
| m/z = 10 to 300. |
| The m of m/z represents the mass number; and z, the valence of ions. |
| Usually, the valence of ions is 1 and hence m/z corresponds to the mass number. |
| Atmosphere: |
| Helium (He) flow (30 ml/min). |

According to the TG-DTG (derivative thermogravimetry) curve obtained by the measurement made under the above conditions, two-stage remarkable weight reduction was seen in the vicinity of 400 to 500° C. and in the vicinity of 500 to 650° C.

Here, in respect of the gas generated at 400 to 500° C., oxyalkylene groups (due to glycidoxy groups of the glycidoxypropyltriethoxysilane) of 31, 43, 58 and 59 in mass number (m/z) were ascertained. From the weight reduction percentage, the oxyalkylene group content in the polysiloxane was found to be 13.30% by mass based on the total mass of the polysiloxane. Aryl groups having the mass number (m/z) of 78 (benzene) and 91 (toluene) were also ascertained. From the weight reduction percentage, the aryl group content in the polysiloxane was found to be 6.80% by mass based on the total mass of the polysiloxane. In addition, alkyl groups of 16, 41, etc. in mass number (m/z) were ascertained, and from the weight reduction percentage, the alkyl group content in the polysiloxane was 12.20% by mass based on the total mass of the polysiloxane.

In respect of the gas generated at 500 to 650° C., alkyl fluoride groups (due to alkyl fluoride groups of the tridecafluoro-1,1,2,2-tetrahydrooctyltriethoxysilane) of 51, 69, 119 and 131 in mass number (m/z) were ascertainable. From the weight reduction percentage, the alkyl fluoride group content in the polysiloxane was found to be 7.10% by mass based on the total mass of the polysiloxane.

Residues are considered to be siloxane moieties in the polysiloxane, and hence the content of the siloxane moieties in the polysiloxane is 100.00−(13.30+6.80+7.10+12.20)=60.60% by mass based on the total mass of the polysiloxane.

The above measurement results are shown in Tables 4 and 5.

Evaluation of Charging Member:

Using a charging roller I produced in the same manner as the above, evaluation was made as shown below.

First, the charging roller I and an electrophotographic photosensitive member were set in a process cartridge in which they were integrally supported. This process cartridge was mounted to a laser beam printer for A4-paper lengthwise feed. The development system of this laser beam printer is a reversal development system, where transfer medium feed speed is 47 mm/s, and image resolution is 600 dpi.

In addition, the electrophotographic photosensitive member set in the process cartridge together with the charging roller I is an organic electrophotographic photosensitive member comprising a support and an organic photosensitive layer formed thereon of 14 μm in layer thickness. This organic photosensitive layer is a multi-layer type photosensitive layer having a charge generation layer and a charge transport layer containing a modified polyarylate (binder resin) which are superposed in this order from the support side. This charge transport layer is corresponding to the surface layer of the electrophotographic photosensitive member.

A toner used in the laser beam printer is what is called a polymerization toner comprising toner particles which are particles obtained by suspension-polymerizing in an aqueous medium a polymerizable monomer system containing a wax, a charge control agent, a colorant, and styrenes butyl acrylate and ester monomers and to which particles fine silica particles and fine titanium oxide particles have externally been added. Its glass transition temperature is 63° C. and its volume-average particle diameter is 6 μm.

Images were reproduced in an 30° C./80% RH environment. Halftone images (images composed of lines one dot in width, drawn at intervals of two dots in the direction perpendicular to the rotational direction of the electrophotographic photosensitive member) were formed on 3,000 sheets of A4-size paper at a process speed of 47 mm/s.

In respect of problems in the reproduced images, resulting from deterioration in electrical properties, it was observed whether the patterns formed in the first one round of the electrophotographic photosensitive member were re-transferred on transfer mediums in the second or later round of the electrophotographic photosensitive member (hereinafter referred to as "ghost"). In the observation, images were used in which five solid-black (density: 100%) lattices were drawn in the state that they were arranged in the direction perpendicular to the paper feed direction at areas 1 cm and 15 cm apart from the edges of the paper having the above halftone images.

To evaluate the images reproduced, the images reproduced were visually observed at the time of one-sheet image reproduction (initial stage) and after 3,000-sheet image reproduction.

Evaluation criteria are as shown below.

A: No ghost has occurred at all.

B: Ghost has extremely thinly occurred.

C: Ghost has thinly occurred.

D: Ghost has clearly occurred.

Results of the above evaluation are shown in Table 6.

Examples 2 to 6 & Comparative Examples 1 and 2

Charging rollers were produced in the same manner as in Example 1 except that the materials used in obtaining the condensation product of hydrolyzable silane compounds (the condensation product I in Example 1) (i.e., types and amounts (mol) of hydrolyzable silane compounds and amounts (g) of water and ethanol) and conditions for synthesis (i.e., heat-refluxing conditions (temperature and time), pH and Roh) were changed as shown in Tables 2 and 3. The charging rollers produced in Examples 2 to 6 are designated as charging rollers II to VI, respectively. The charging rollers produced in Comparative Examples 1 and 2 are designated as Charging rollers CI and CII, respectively.

TABLE 2

| | | Hydrolyzable silane compounds | | | | | | |
|---|---|---|---|---|---|---|---|---|
| | Charging roller | PhTES (mol) | GPTES (mol) | HeTMS (mol) | FTS (mol) | MTES (mol) | Water (g) | Ethanol (g) |
| Example: | | | | | | | | |
| 1 | I | 0.156 | 0.078 | 0.064 | 0.022 | — | 25.9 | 71.9 |
| 2 | II | 0.175 | 0.058 | 0.064 | 0.022 | — | 25.9 | 72.8 |
| 3 | III | 0.187 | 0.047 | 0.064 | 0.022 | — | 25.9 | 71.0 |
| 4 | IV | 0.186 | 0.062 | — | 0.006 | — | 20.6 | 48.6 |
| 5 | V | 0.125 | 0.045 | — | — | 0.005 | 18.8 | 25.7 |
| 6 | VI | — | 0.060 | — | 0.006 | 0.060 | 20.4 | 14.6 |
| Comparative Example: | | | | | | | | |
| 1 | CI | — | 0.150 | — | 0.014 | 0.160 | 26.2 | 29.4 |
| 2 | CII | — | 0.130 | — | 0.012 | 0.140 | 7.6 | 40.2 |

TABLE 3

| | Charging roller | Heat-refluxing Temp. (° C.) | Time | pH | Roh |
|---|---|---|---|---|---|
| Example: | | | | | |
| 1 | I | 120 | 24 | 5 | 1.5 |
| 2 | II | 120 | 24 | 5 | 1.5 |
| 3 | III | 120 | 24 | 5 | 1.5 |
| 4 | IV | 100 | 24 | 5 | 1.5 |
| 5 | V | 100 | 24 | 5 | 2.0 |
| 6 | VI | 100 | 24 | 5 | 3.0 |
| Comparative Example: | | | | | |
| 1 | CI | 60 | 1 | 5 | 1.5 |
| 2 | CII | 100 | 24 | 5 | 0.5 |

Measurement of physical properties, and evaluation, of the charging rollers II to VI and CI and CII were made in the same manner as in Example 1. The measurement results are shown in Tables 4 and 5, and the evaluation results, in Table 6.

TABLE 4

| | Charging roller | Surface layer Layer thickness (μm) | Rz (μm) | Modulus of elasticity (MPa) | Time constant τ (s) |
|---|---|---|---|---|---|
| Example: | | | | | |
| 1 | I | 0.48 | 5.6 | 900 | $4.44 \times 10^2$ |
| 2 | II | 0.49 | 4.8 | 1,890 | $1.31 \times 10^3$ |
| 3 | III | 0.51 | 5.2 | 1,560 | $6.97 \times 10^2$ |
| 4 | IV | 0.50 | 4.9 | 2,000 | $1.31 \times 10^2$ |
| 5 | V | 0.49 | 4.5 | 3,000 | $4.15 \times 10^3$ |
| 6 | VI | 0.52 | 5.1 | 1,180 | $5.32 \times 10^2$ |
| Comparative Example: | | | | | |
| 1 | CI | 0.48 | 5.0 | 40 | $2.01 \times 10^1$ |
| 2 | CII | 0.51 | 5.5 | 6,000 | $1.00 \times 10^1$ |

TABLE 5

| | Charging roller | {(X + Y)}/(X + Y + Z)} | Functional groups in polysiloxane Oxy alkylene groups (mass %) | Aryl groups (mass %) | Alkyl groups (mass %) | Alkyl fluoride groups (mass %) | Siloxane moieties (mass %) |
|---|---|---|---|---|---|---|---|
| Example: | | | | | | | |
| 1 | I | 0.60 | 13.30 | 6.80 | 12.20 | 7.10 | 60.60 |
| 2 | II | 0.68 | 12.90 | 7.20 | 11.20 | 6.10 | 62.60 |
| 3 | III | 0.70 | 10.90 | 7.90 | 8.70 | 6.80 | 65.70 |
| 4 | IV | 0.62 | 30.90 | 7.70 | — | 10.90 | 50.50 |
| 5 | V | 0.78 | 31.70 | 8.10 | — | — | 60.20 |
| 6 | VI | 0.63 | 33.58 | — | — | 18.70 | 47.72 |
| Comparative Example: | | | | | | | |
| 1 | CI | 0.20 | 38.80 | — | — | 11.90 | 49.30 |
| 2 | CII | 0.40 | 34.62 | — | — | 13.80 | 51.58 |

TABLE 6

| | Charging roller | Initial stage | After 3,000-sheet image reproduction |
|---|---|---|---|
| Example: | | | |
| 1 | I | A | A |
| 2 | II | A | A |
| 3 | III | A | A |
| 4 | IV | A | A |
| 5 | V | A | B |
| 6 | VI | B | B |
| Comparative Example: | | | |
| 1 | CI | C | D |
| 2 | CII | D | D |

As described above, according to the present invention, the charging member can be provided which can maintain superior performance even when repeatedly used in a high-humidity environment, and also the process cartridge and the electrophotographic apparatus which have such a charging member can be provided.

This application claims priority from Japanese Patent Application Nos. 2004-379828 filed on Dec. 28, 2004, 2005-149452 filed on May 23, 2005 and 2005-248688 filed on Aug. 30, 2005, which are hereby incorporated by reference herein.

The invention claimed is:

1. A charging member which comprises a surface layer containing a polysiloxane having a first unit represented by $SiO_{0.5}R^1(OR^2)(OR^3)$, a second unit represented by $SiO_{1.0}R^4(OR^5)$ and a third unit represented by $SiO_{1.5}R^6$, where $R^1$, $R^4$ and $R^6$ each independently represent a substituted or unsubstituted alkyl group or a substituted or unsubstituted aryl group, and $R^2$, $R^3$ and $R^5$ each independently represent a hydrogen atom or a substituted or unsubstituted alkyl group;

said surface layer satisfying:

$$0.60 \leqq \{(x+y)/(x+y+z)\} \leqq 0.80$$

where the number of moles of the first unit, the number of moles of the second unit and the number of moles of the third unit in the polysiloxane are represented by x (mol), y (mol) and z (mol), respectively.

2. The charging member according to claim 1, wherein a time constant τ(s) of said surface layer satisfy: $1\times10^2 \leqq \tau 1\times10^4$.

3. The charging member according to claim 1, wherein the aryl groups in said polysiloxane are in a content of from 5 to 30% by mass based on the total mass of said polysiloxane, the oxyalkylene groups in said polysiloxane are in a content of from 5 to 70% by mass based on the total mass of said polysiloxane, and the siloxane moieties in said polysiloxane are in a content of from 20 to 90% by mass based on the total mass of said polysiloxane.

4. The charging member according to claim 1, wherein said polysiloxane further has an alkyl fluoride group, where the aryl groups in said polysiloxane are in a content of from 5 to 30% by mass based on the total mass of said polysiloxane, the oxyalkylene groups in said polysiloxane are in a content of from 5 to 70% by mass based on the total mass of said polysiloxane, the alkyl fluoride groups in said polysiloxane are in a content of from 5 to 50% by mass based on the total mass of said polysiloxane, and the siloxane moieties in said polysiloxane are in a content of from 20 to 85% by mass based on the total mass of said polysiloxane.

5. The charging member according to any one of claims 1 to 4, wherein said polysiloxane is a polysiloxane obtained through the following steps (I) and (II):

(I) a condensation step in which a hydrolyzable silane compound having an aryl group and a hydrolyzable silane compound having a cationic-polymerizable group are condensed by hydrolysis; and (II) a crosslinkage step in which the cationic-polymerizable group is cleaved to crosslink the hydrolyzable condensation product obtained through the step (I).

6. The charging member according to claim 5, wherein said step (I) is a step in which a hydrolyzable silane compound having an aryl group, a hydrolyzable silane compound having a cationic-polymerizable group and a hydrolyzable silane compound represented by the following formula (3) are condensed by hydrolysis:

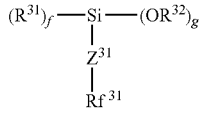

(3)

wherein $R^{31}$ and $R^{32}$ each independently represent a substituted or unsubstituted alkyl group, $Z^{31}$ represents a divalent organic group, and $Rf^{31}$ represents a perfluoro alkyl group having 1 to 31 carbon atoms; and f is an integer of 0 to 2, g is an integer of 1 to 3, and f+g is 3.

7. The charging member according to claim 5, wherein said hydrolyzable silane compound having an aryl group is represented by the following formula (1):

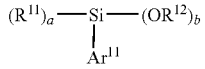

(1)

wherein $R^{11}$ and $R^{12}$ each independently represent a substituted or unsubstituted alkyl group, and $Ar^{11}$ represents an aryl group; and a is an integer of 0 to 2, b is an integer of 1 to 3, and a+b is 3.

8. The charging member according to claim 5, wherein said hydrolyzable silane compound having a cationic-polymerizable group is represented by the following formula (2):

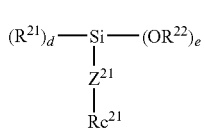

(2)

wherein $R^{21}$ and $R^{22}$ each independently represent a substituted or unsubstituted alkyl group, $Z^{21}$ represents a divalent organic group, and $Rc^{21}$ represents a cationic-polymerizable group; and d is an integer of 0 to 2, e is an integer of 1 to 3, and d+e is 3.

9. The charging member according to claim 5, wherein said cationic-polymerizable group is an epoxy group.

10. A process cartridge which comprises an electrophotographic photosensitive member and a charging member for charging the surface of the electrophotographic photosensitive member, which are integrally supported; the process cartridge being detachably mountable to the main body of an electrophotographic apparatus; wherein said charging member is the charging member according to claim 1.

11. The process cartridge according to claim 10, wherein said charging member is disposed in contact with said electrophotographic photosensitive member.

12. An electrophotographic apparatus which comprises an electrophotographic photosensitive member and a charging member for charging the surface of the electrophotographic photosensitive member, wherein said charging member is the charging member according to any one of claims 1 to 4.

13. The electrophotographic apparatus according to claim 12, wherein said charging member is disposed in contact with said electrophotographic photosensitive member.

14. The electrophotographic apparatus according to claim 12, wherein said charging member has a voltage applying means for applying only a voltage of direct-current voltage to said charging member.

* * * * *